US006227640B1

(12) United States Patent
Maze et al.

(10) Patent No.: US 6,227,640 B1
(45) Date of Patent: May 8, 2001

(54) VARIABLE DROP MASS INKJET DROP GENERATOR

(75) Inventors: Robert C. Maze; Todd A. Cleland; Arun K Agarwal, all of Corvallis, OR (US); Mark A Buonanno, Sunnyvale, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/302,178

(22) Filed: Apr. 29, 1999

Related U.S. Application Data

(63) Continuation-in-part of application No. 08/218,951, filed on Mar. 23, 1994, now Pat. No. 6,070,969.

(51) Int. Cl.[7] ..... B41J 2/205; B41J 2/05

(52) U.S. Cl. ..... 347/15; 347/63; 347/64; 347/67

(58) Field of Search ..... 347/56, 62, 63, 347/64, 67, 15, 43

(56) References Cited

U.S. PATENT DOCUMENTS

| | | | | |
|---|---|---|---|---|
| 4,339,762 | * | 7/1982 | Shirato et al. | 347/62 |
| 4,514,741 | | 4/1985 | Meyer | 347/62 |
| 4,792,818 | * | 12/1988 | Eldridge et al. | 347/63 |
| 4,862,197 | | 8/1989 | Stoffel | 347/59 |
| 4,870,433 | | 9/1989 | Campbell et al. | 347/62 |
| 4,935,752 | | 6/1990 | Hawkins | 347/62 |
| 5,083,137 | | 1/1992 | Badyal et al. | 349/14 |
| 5,206,659 | | 4/1993 | Sakurai et al. | 347/62 |
| 5,293,182 | | 3/1994 | Sekiya et al. | 347/62 |
| 5,428,376 | | 6/1995 | Wade et al. | 347/14 |
| 5,455,613 | | 10/1995 | Canfield et al. | 347/65 |
| 5,486,848 | * | 1/1996 | Ayata et al. | 347/15 |
| 5,521,622 | * | 5/1996 | Hock et al. | 347/43 |
| 5,636,441 | | 6/1997 | Meyer et al. | 29/890.1 |
| 5,673,069 | | 9/1997 | Canfield et al. | 347/15 |
| 5,726,690 | | 3/1998 | Bohorquez et al. | 347/15 |
| 5,808,640 | | 9/1998 | Bhaskar et al. | 347/58 |

FOREIGN PATENT DOCUMENTS

| | | | | |
|---|---|---|---|---|
| 124312A2 | | 4/1984 | (EP) | B41J/3/04 |
| 613781 | * | 2/1994 | (EP) | B41J/2/205 |
| 63-34144 | | 7/1986 | (JP) | B41J/3/04 |
| 2-103150 | | 10/1988 | (JP) | B41J/2/05 |

* cited by examiner

*Primary Examiner*—John Barlow
*Assistant Examiner*—Juanita Stephens
(74) *Attorney, Agent, or Firm*—Raymond A. Jenski

(57) ABSTRACT

An inkjet printing device employs an inkjet printhead with a plurality of drop generators to eject drops of ink. Each drop generator includes a planar heater resistor, a protection layer having a first heating surface on the heater resistor and a second heating surface entirely surrounding the first heater surface on the heater resistor, and an ink ejection nozzle. The drop generator vaporizes ink at the first heating surface and ejects a drop of ink of a first mass from the nozzle when a first range of energies is applied to the heater resistor. The drop generator vaporizes ink at the first heating surface and the second heating surface and ejects a drop of ink of a second mass from the nozzle when a second range of energies is applied to the heater resistor.

34 Claims, 8 Drawing Sheets

VARIABLE DROP MASS INKJET DROP GENERATOR

The present invention is a continuation-in-part of earlier U.S. patent application Ser. No. 08/218,951 filed on Mar. 23, 1994 now U.S. Pat. No. 6,070,969, titled "Thermal Inkjet Printhead Having a Preferred Nucleation Site" and assigned to the assignee of the present invention.

BACKGROUND OF THE INVENTION

The present invention relates generally to methods and apparatus for reproducing images and alphanumeric characters, and more particularly to a thermal inkjet drop generator, printhead construction, and the respective method of operation.

The art of inkjet printing technology is relatively well developed. Commercial products such as computer printers, graphics plotters, copiers, and facsimile machines employ inkjet technology for producing hard copy printed output. The basics of this technology are disclosed, for example, in various articles in the Hewlett-Packard Journal, Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No. 1 (February 1994) editions. Inkjet devices are also described by W. J. Lloyd and H. T. Taub in Output Hardcopy Devices, chapter 13 (Ed. R. C. Durbeck and S. Sherr, Academic Press, San Diego, 1988).

A thermal inkjet printer for inkjet printing typically includes one or more translationally reciprocating print cartridges in which small drops of ink are formed and ejected towards a medium upon which it is desired to place alphanumeric characters, graphics, or images. Such cartridges include a printhead having an orifice member or plate that has a plurality of small nozzles through which the ink drops are ejected. Adjacent to the nozzles are ink firing chambers, in which ink resides prior to ejection through the nozzle. Ink is supplied to the ink-firing chambers through ink channels that are in fluid communication with an ink supply, which may be contained in a reservoir portion of the print cartridge or in a separate ink container spaced apart from the printhead.

Ejection of an ink drop through a nozzle employed in a thermal inkjet printer is accomplished by quickly heating a volume of ink within the adjacent ink firing chamber with a selectively energizing electrical pulse to a heater resistor positioned in the ink firing chamber. At the commencement of the heat energy output from the heater resistor, bubble nucleation generally commences at locations of dissimilarities in the ink liquid or at defect sites on the surface of the heater resistor or other interface surfaces (heterogeneous nucleation). It is well known that heterogeneous nucleation of an ink vapor bubble is favored to occur energetically at interfaces. Although it is possible to promote homogeneous nucleation, it is not possible to do so in the absence of heterogeneous nucleation occurring at the interface between the ink and the contact surface where heat transfer occurs. If the location of these nucleation sites is not optimized, bubble formation will occur randomly or at various uncontrolled sites within the ink firing chamber. Therefore, although one may wish to drive the process to homogeneous nucleation on the heating surface of the structure, it is heterogeneous nucleation which occurs due to its reduced energy requirement at the high energy interface. The rapid expansion of the ink vapor bubble forces ink through the nozzle. Once ink is ejected, the ink-firing chamber is refilled with ink from the ink channel and ink supply.

The energy required to eject a drop of a given volume is referred to as "turn on energy". The turn-on energy, is a sufficient amount of energy to form a vapor bubble having sufficient size to eject a predetermined amount of ink through the printhead nozzle. Following removal of electrical power from the heater resistor, the vapor bubble collapses in the firing chamber in a small but violent way. Components within the printhead in the vicinity of the vapor bubble collapse are susceptible to fluid mechanical stresses (cavitation) as the vapor bubble collapses and ink crashes into the ink firing chamber components between firing intervals. The heater resistor is particularly susceptible to damage from cavitation. A thin hard protective passivation layer is typically applied over the resistor and adjacent structures to protect the resistor from cavitation. The passivation layer, however, tends to increase the turn-on energy required for ejecting droplets of a given size. Another layer is typically placed between the cavitation layer and the heater resistor and associated structures. Thermal inkjet ink is chemically reactive, and prolonged exposure of the heater resistor and its electrical interconnections to the ink will result in a chemical attack upon the heater resistor and electrical conductors. A hard non-conductive passivation layer is disposed over the heater resistor to provide this protection from the ink. The cavitation layer and the passivation layer can be thought of, in concert, as a protective layer. Significant effort has been expended in the past to protect the heater resistor from cavitation and attack, including the separating of the heater resistor into several parts and leaving a center zone (upon which a majority of the cavitation energy concentrates in a top firing thermal inkjet firing chamber) free of resistive material.

Significant effort is also expended in improving print quality. Print quality has become one of the most important considerations of competition in the color inkjet printer field. Since the image output of a color inkjet printer is formed of individual ink drops, the quality and fidelity of the image is ultimately dependent upon the quality of each ink drop and its placement and arrangement as a dot on the printed medium.

One source of reduced print quality is improper ink drop volume. It is known that drop volumes vary with the printhead substrate temperature because the properties that control it vary with temperature: the viscosity of the ink itself and the amount of ink vaporized by a heater resistor when driven by a given electrical printing pulse. Changes in drop volume also cause variations in the darkness of black text, variations in the contrast of gray-scale images, as well as variations in the chroma, hue, and lightness of color images. In a printing system that employs a limited number of color inks, the chroma, hue, and lightness of a printed color depends upon the volume of all the primary color drops that create the printed color. If the printhead substrate temperature increases or decreases as a page of media is printed, the colors at the top of the page can differ from the colors at the bottom of the page. Additionally, when at room temperature, a thermal inkjet printhead must eject drops of sufficient size to form satisfactory printed text or graphics. However, printheads that meet this performance requirement can eject drops containing excessive amounts of ink when the printhead substrate is warm. Excessive ink degrades print quality by causing feathering of the ink dots, bleeding of the dots having different colors, and cockle and curling of the medium. In addition, different print media, i.e., plain paper, special paper, or transparency material, require different ink drop volumes for optimum performance. Controlling the ink drop volume depending upon the above conditions helps to eliminate these problems and improve print quality.

Generally, the drop volume from an inkjet printer printhead can be adjusted by varying the drop generator physical geometry (changing the heater resistor size and nozzle orifice size), varying the ink refill speed (changing the backpressure, ink filter fluid resistance, and ink feed channel restrictions), varying the size and strength of the vaporization bubble (adjusting ink temperature, nucleation surface heating rate, and nucleation surface roughness and cleanliness), and varying fluidic response such as ink viscosity (which is also a function of ink temperature). A related method of adjusting drop volume is that of ejecting multiple smaller droplets to deposit neighboring or overlapping dots on the printed medium. The foregoing factors can be divided into two categories: factors that can be dynamically changed by operation of the printer and factors that are fixed design parameters. Of the above factors, only temperature, nucleation surface heating rate, and multiple droplet expulsion can be dynamically adjusted by the printer.

Printhead temperature control has been discussed in, for example, U.S. Pat. No. 5,673,069 "Method and Apparatus for Reducing the Size of Drops Ejected from a Thermal Ink Jet Printhead". Variation in the electrical pulse width supplied to the heater resistor, thereby affecting nucleation surface heating rate, will produce a variable drop volume proportional to the pulse width. U.S. Pat. No. 5,726,690, "Control of Ink Drop Volume in Thermal Inkjet Printheads by Varying the Pulse Width of the Firing Pulses" discloses a method for doing so. Others have shown that printheads could be constructed with a protective layer having a thickness gradient. See U.S. Pat. No. 4,339,762, "Liquid Jet Recording Method". This gradient provides a positional variation in the point of bubble nucleation relative to the applied electric potential. When utilized in a system that ejects ink drops parallel to the plane of the heater resistor, the volume of the drop of ink can be made a function of the location of nucleation on the heater resistor and therefore a function of the applied electric potential. Multiple droplet deposition, such as that described in U.S. Pat. No. 4,967,203, "Interlace Printing Process "; U.S. Pat. No. 4,999,646, "Method for Enhancing the Uniformity and Consistency of Dot Formation Produced by Color Ink Jet Printing"; and U.S. Pat. No. 5,583,550, "Ink Drop Placement for Improved Imaging", have the disadvantage of decreasing the throughput of the printer.

The efforts of others notwithstanding, a variable and stable drop mass thermal inkjet printer printhead has not been readily achieved. It is highly desirable, at least for reasons of alphanumeric character quality and color image fidelity, that a dynamic selection of ink drop volume be made available for an inkjet printer without excessive cost or reduction in throughput.

SUMMARY OF THE INVENTION

An inkjet printing apparatus and its methods of manufacture and use encompass a planar heater resistor having a shape of a first geometric figure with a perimeter. The planar heater resistor is disposed on and has a first surface in contact with a substrate. A first electrical conductor and a second electrical conductor are coupled to the planar heater resistor such that an electrical voltage applied between the electrical conductors produces heat energy dissipated by the planar heater resistor. A protection layer is disposed at least on a second surface of the planar heater resistor. This protection layer has a first thickness disposed in the shape of a second geometric figure at a predetermined location entirely within a boundary in the protection layer congruent with the perimeter. The protection layer also has a second thickness surrounding the first thickness, the second thickness having a greater magnitude than the first thickness.

DESCRIPTION OF THE PREFERRED EMBODIMENTS

Figure 1:
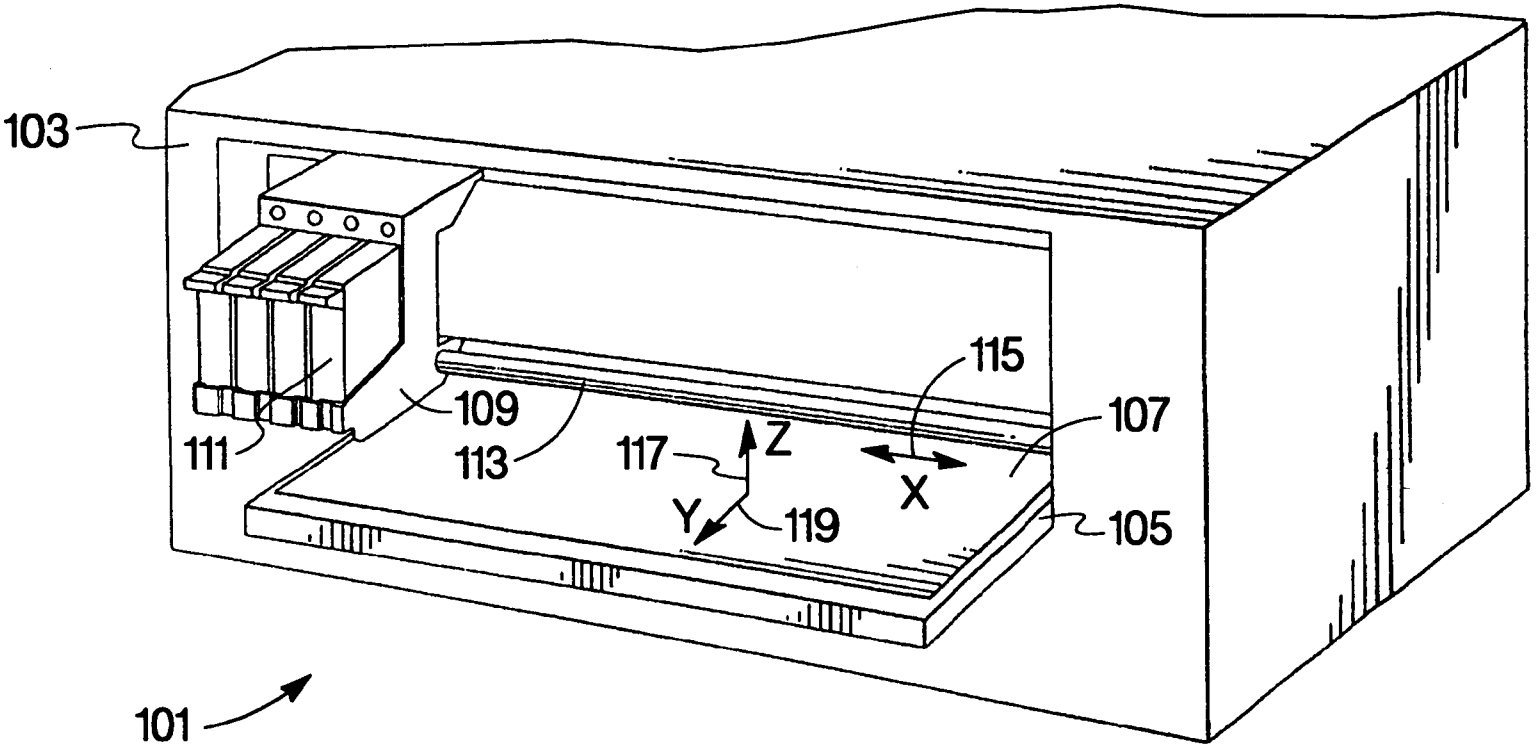
FIG. 1 is an illustration in perspective view (partial cut-away) of an illustrative inkjet printer apparatus (cover panel facia removed) in which the present invention may be incorporated.

An inkjet printing apparatus can achieve higher print quality and improved color image fidelity when a dynamically controlled ink drop mass can be ejected from the printhead. An exemplary inkjet printer 101 which may realize this goal, is shown in rudimentary form in FIG. 1. A printer housing 103 contains a platen 105 to which input print media 107 is transported by mechanisms which are known in the art. A carriage 109 holds a set of individual print cartridges, e.g. 111, one having cyan ink, one having magenta ink, one having yellow ink, and one having black ink. Alternative embodiments can include semi-permanent printhead mechanisms having at least one small volume, on-board, ink chamber that is sporadically replenished from fluidically-coupled, off-axis, ink reservoirs or print cartridges having two or more colors of ink available within the print cartridge and ink ejecting nozzles specifically designated for each color; the present invention is applicable to inkjet cartridges of any of the alternatives. The carriage 109 is typically mounted on a slide bar 113, allowing the carriage 109 to be reciprocated or scanned back and forth across the print media 107. The scan axis, X, is indicated by arrow 115. As the carriage 109 scans, ink drops are selectively ejected from the set of print cartridges onto the media 107 in predetermined print swath patterns, forming images or alphanumeric characters using dot matrix manipulation. Generally, the dot matrix manipulation is determined by a computer (not shown) and instructions are transmitted to a microprocessor-based, electronic controller (not shown) within the printer 101. The ink drop trajectory axis, Z, is indicated by arrow 117. When a swath of print has been completed, the media 107 is moved an appropriate distance along the print media axis, Y, indicated by arrow 119 in preparation for the printing of the next swath.

Figure 2:
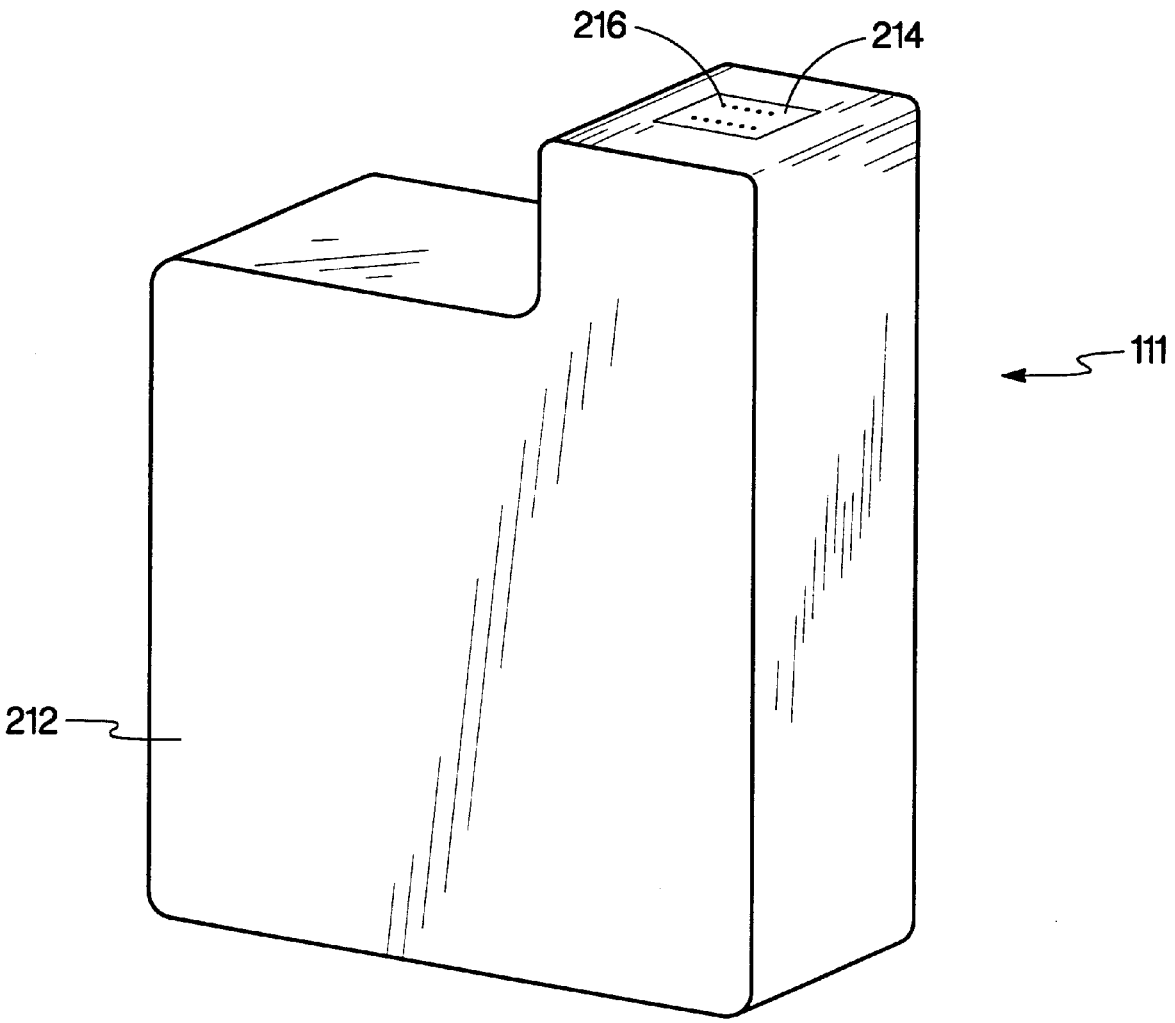
FIG. 2 is an isometric illustration of an inkjet print cartridge useable in the printer apparatus of FIG. 1.

An exemplary thermal inkjet cartridge 111 is shown in FIG. 2. A cartridge housing, or shell, 212 contains an internal reservoir of ink (not shown). The cartridge 111 is provided with a printhead 214 that includes a foraminous orifice plate 216 having a plurality of miniature nozzles constructed in combination with subjacent firing chambers and structures leading to respective ink ejectors, and electrical contacts for coupling to the printer 101. A single ink drop generator is illustrated in the magnified isometric cross section of FIG. 3. As depicted, the drop generator comprises a nozzle, a firing chamber, and an ink ejector. Alternative embodiments of a drop generator employ more than one coordinated nozzle, firing chamber, and/or ink ejectors.

Figure 3:
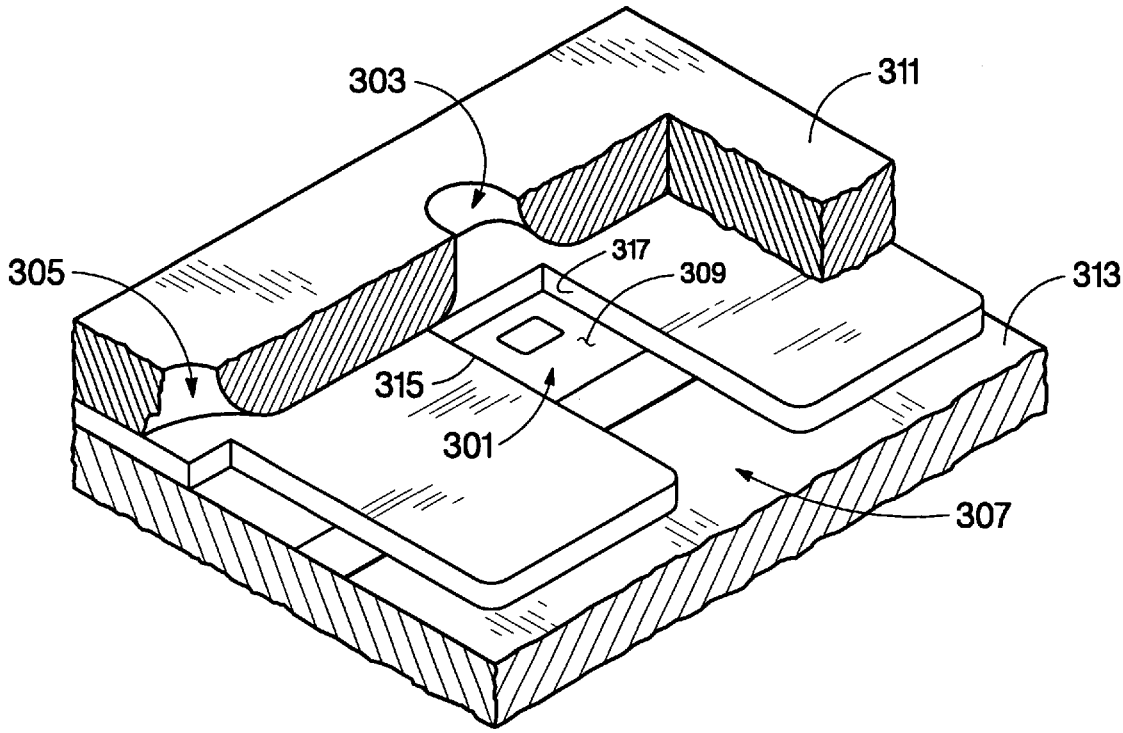
FIG. 3 is a magnified isometric cross section of a drop generator element of the printhead component of FIG. 2.

The ink ejector and associated ink feed channels of printhead 214 is shown in FIG. 3. An ink firing chamber 301 is shown in correspondence with a nozzle 303 in a preferred embodiment. Part of a second nozzle 305, associated with another ink firing chamber, is also shown. Many independent nozzles are typically arranged in a predetermined pattern on the orifice plate so that the ink which is expelled from selected nozzles creates a defined character or image of print on the medium. Generally, the medium is maintained in a position which is parallel to the external surface of the orifice plate. Ink is supplied to the firing chamber 301 via opening 307 to replenish ink that has been expelled from orifice 303 when ink has been vaporized by localized heating from a heater resistor 309. The ink firing chamber is bounded by walls created by an orifice plate 311, a layered semiconductor substrate 313, and firing chamber walls 315, 317. In a preferred embodiment, fluid ink stored in a reservoir of the cartridge housing 212 flows by capillary force to fill the firing chamber 301.

Nozzle configuration is a design factor that controls droplet size, velocity, and trajectory of the droplets of ink in the Z-axis (toward the medium to be printed upon). The nozzles are arranged in a predetermined association with the ink ejectors (heater resistors, in a thermal inkjet printhead). This association is usually with the center axis of the nozzle perpendicular to the plane of the heater resistor and coincident with the center point of the heater resistor. Placing nozzle orifices close together presents a problem in the designing of ink ejectors and the electrical connections which must be made to them. These electrical interconnections are typically thin film metalized conductors that electrically connect the ink ejectors on the printhead to contact pads, thence to printhead interface circuitry in the printer. A technique commonly known as "integrated drive head" or IDH multiplexing is conventionally used to reduce electrical interconnections between a printer and its associated print cartridges. Examples of IDH multiplexing may be found in U.S. Pat. No. 5,541,629 "Printhead with Reduced Interconnections to a Printer". In an IDH design, the ink ejectors (heater resistors) are split into groups known as primitives. Each primitive has its own power supply interconnection ("primitive select") and return interconnection ("primitive return" or "primitive common"). In addition, a number of control lines ("address lines") are used to enable particular heater resistors. These address lines are shared among all primitives. The energizing of each heater resistor is controlled by activation of a primitive select and by a transistor such as a MOSFET that acts as a switch connected in series with each resistor. By applying a voltage across one or more primitive selects (PS1, PS2, etc. in FIG. 4) and the primitive return, and activating the associated gate of a selected transistor, multiple independently addressed heater resistors may be fired simultaneously.

Figure 4:
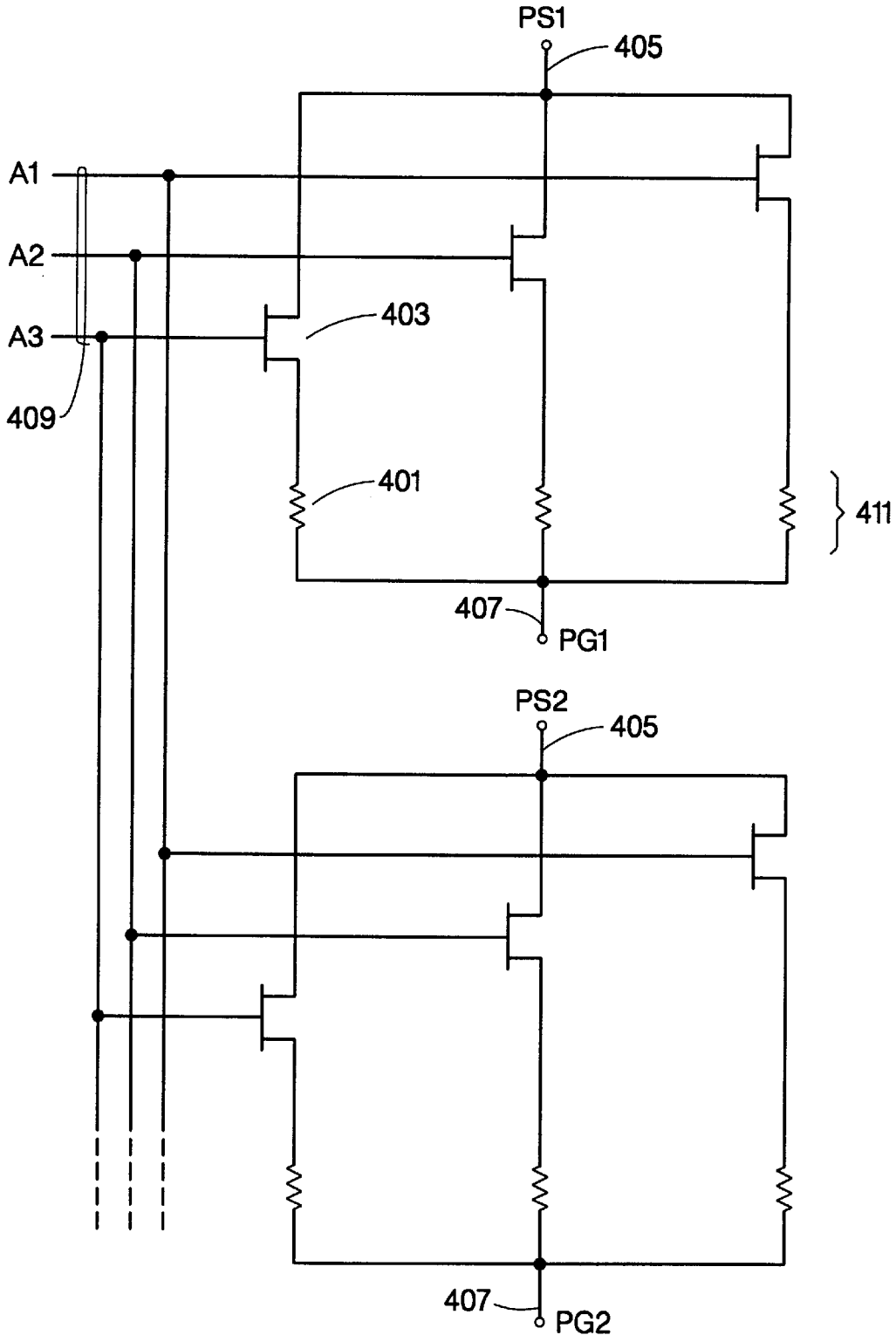
FIG. 4 is an electrical schematic that illustrates a typical heater resistor IDH circuitry for the printhead of FIG. 2.

FIG. 4 is an electrical schematic that illustrates a typical ink ejector IDH matrix circuitry on the printhead. This configuration enables the selection of which ink ejectors to fire in response to print commands from the printer. The ink ejectors are arranged in correspondence with the nozzle orifices and are identified in the electrical matrix by enable signals within a print command directed to the printhead by the printer. Each ink ejector generally comprises a heater resistor (for example, resistor 401) and a switching device (for example, transistor 403). Common electrical connections include a primitive select (PS(n)) lead 405, a primitive common (PG(n)) lead 407, and address interconnections 409. Each switching device (e.g. 403) is connected in series with each heater resistor (e.g. 401) between the primitive select 405 and primitive common 407 leads. The address interconnections 409 (e.g. address A3) are connected to the control port of the switch device (e.g. 403) for switching the device between a conductive state and a nonconductive state. In the conductive state, the switch device 403 completes a circuit from the primitive select lead 405 through the heater resistor 401 to the primitive common lead 409 to energize the heater resistor when primitive select PSI is coupled to a source of electrical power.

Each row of ink ejectors in the matrix is deemed a primitive and may be selectively prepared for firing by powering the associated primitive select lead 405, for example PS1 for the row of heater resistors designated 411 in FIG. 4. While only three heater resistors are shown here, it should be understood that any number of heater resistors can be included in a primitive, consistent with the objectives of the designer and the limitations imposed by other printer and printhead constraints. Likewise, the number of primitives is a design choice of the designer. To provide uniform energy for the heater resistors of the primitive, it is preferred that only one series switch device per primitive be energized at a time. However, any number of the primitive selects may be enabled concurrently. Each enabled primitive select, such as PSI or PS2, thus delivers both power and one of the enable signals to the ink ejector. One other enable signal for the matrix is an address signal provided by each control interconnection 409, such as A1, A2, etc., only one of which is preferably active at a time. Each address interconnection 409 is coupled to all of the switch devices in a matrix column so that all such switch devices in the column are conductive when the interconnection is enabled or "active," i e. at a voltage level which turns on the switch devices. Where a primitive select and an address interconnection for a heater resistor R are both active concurrently, that resistor is electrically energized, rapidly heats, and vaporizes ink in the associated ink firing chamber.

Figure 5:
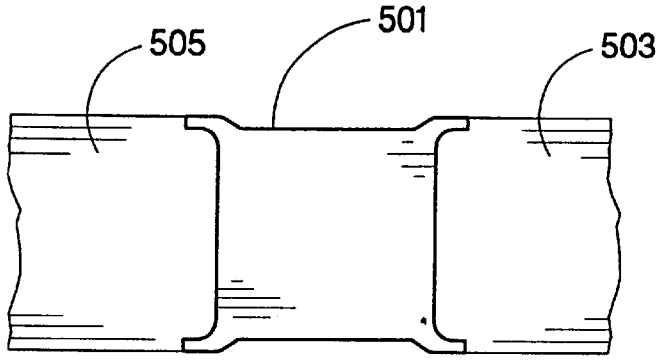
FIG. 5 is a plan view of a heater resistor and interconnecting electrical conductors for one drop generator which may benefit from the present invention.
Figure 6:
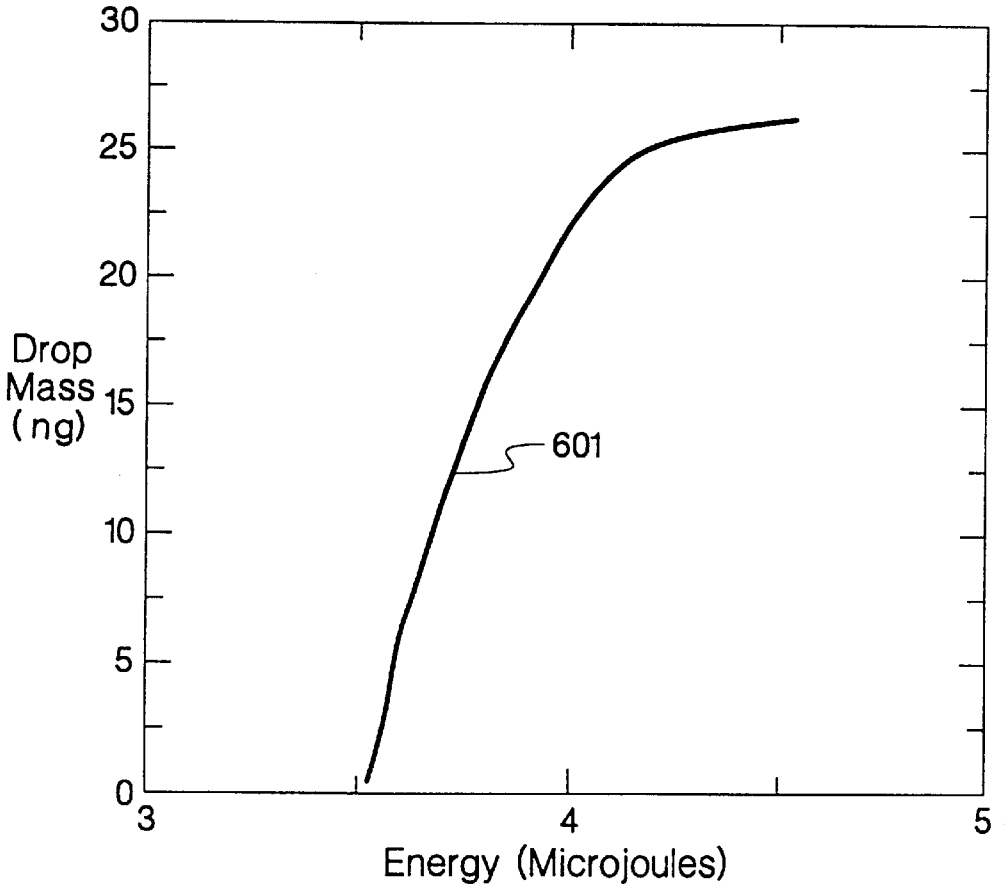
FIG. 6 is an energy-drop mass curve for a drop generator utilizing the heater resistor of FIG. 5.

A top plan view of a heater resistor 501 and its associated conductors 503, 505 are shown in FIG. 5. The orifice plate that contains the nozzle and any other firing chamber structures have been deleted for clarity here. In the preferred embodiment, the heater resistor is realized as a thin film planar structure having a square geometric figure pattern 30 micrometers on a side. Other geometric figures, e.g. trapezoids, split resistors (parallel or series connected), and other useful geometric figures may also be used. The electrical conductors leading to heater resistor 501 are realized as thin film metallic conductors electrically and physically connected to the heater resistor on opposite sides of the planar heater resistor. Electric current can flow from the conductor disposed on one side of the heater resistor, through the heater resistor, to the other conductor. When an electric voltage is connected across the conductors, electric current flows through the heater resistor for the duration of the connection resulting in energy being dissipated in the heater resistor as heat. It is desired that a majority of the heat be quickly transferred to the ink that is contained in the firing chamber and that an ink ejecting ink vapor bubble be formed to eject a volume of ink. The relationship of the amount of ink ejected and the energy supplied to the heater resistor is shown in the graphical relationship of FIG. 6. Notice that the curve 601 has a steep slope and a rapid variation of ink drop weight relative to a small change of resistor energy until the slope of the curve changes at a drop weight of approximately 25 ng. This inflection point is generally acknowledged as the turn on energy of the drop generator. While it is desired that there be a variable drop weight as a function of applied energy, the function must be stable. As discussed earlier, ink temperature and other nucleation surface heating rate parameters affect ejected drop mass. If the energy-drop mass curve slope is too steep, the amount of ink ejected for a given energy appears unstable relative to the ability to control drop weight by modulating the input energy, and the size of the deposited ink dot will vary relatively uncontrollably. Once the turn-on energy is exceeded by a small amount (e.g. 5 to 10 percent), routine fluctuations in energy and ink viscosity do not affect the amount of ink in an ejected ink droplet by a detrimental amount.

Since it is highly desirable to be able to vary the size of the ink drop to obtain higher print quality, one would like to dynamically choose an ink drop mass as the printer is printing. The steep energy-drop mass relationship of conventional drop generators does not reliably produce ink drops of a desired mass because environmental conditions easily change the relationship. It is a feature of the present invention that a stable two-state energy-drop mass relationship is achieved. A two-state energy-drop mass relationship allows ink drops of two different masses to be selectively ejected from the printhead as determined by the energy applied to the heater resistor.

Figure 7:
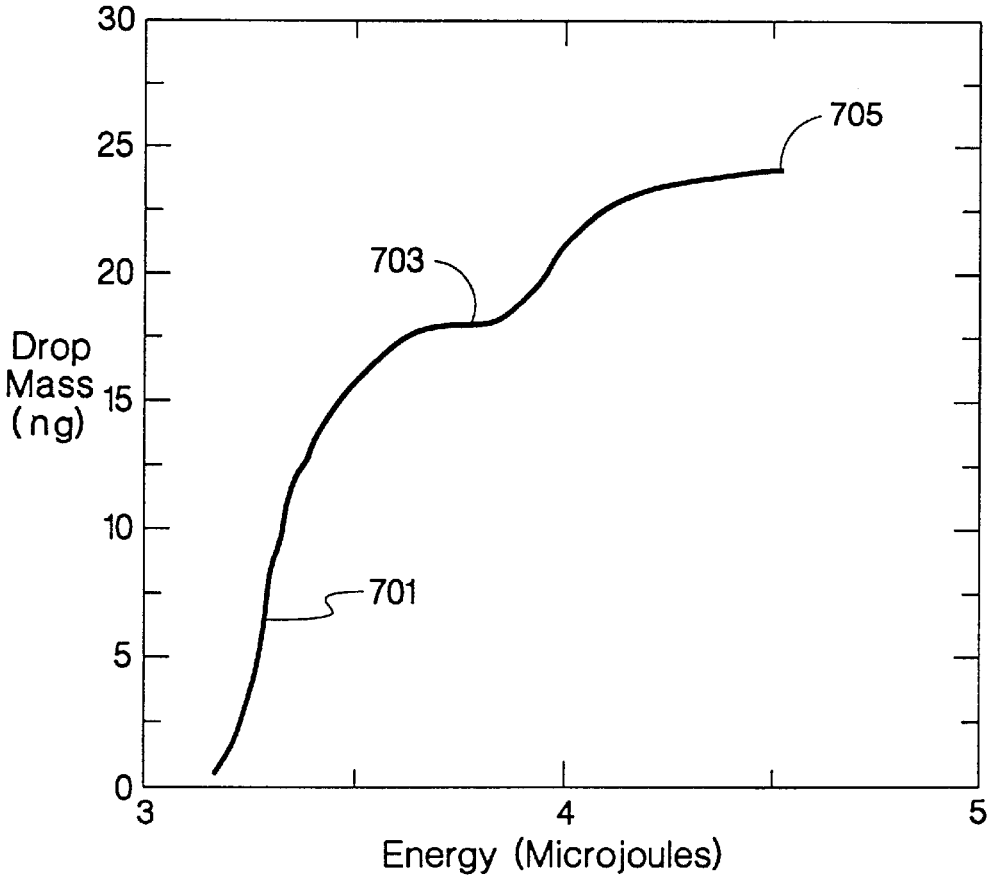
FIG. 7 is an energy-drop mass curve for a drop generator which may employ the present invention.

A two state energy-drop mass relationship is shown in the plot of energy versus drop mass of FIG. 7. There are two plateaus in the relationship curve 701. The first plateau occurs at 703 where a stable drop mass of approximately 17 ng is ejected for energies ranging approximately from 3.6 microjoules to 3.8 microjoules. The second plateau occurs at 705, where a stable drop mass of approximately 23 ng is ejected for energies having the range from approximately 4.5 microjoules to the maximum energy allowed for reliable, sustained heater resistor performance. This performance is achieved in the preferred embodiment with an additional processing step performed on the tantalum cavitation layer. In an alternative embodiment, the step is accomplished in the passivation layer.

Figure 8:
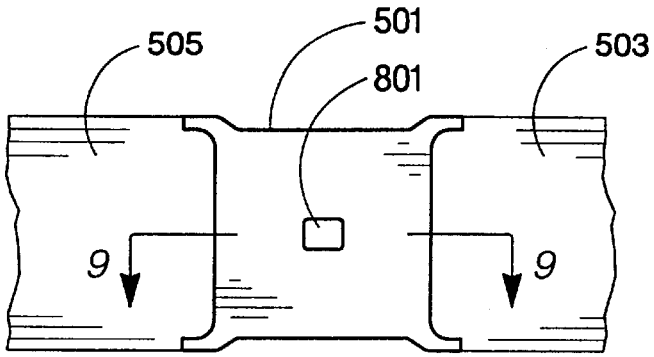
FIG. 8 is a plan view of a heater resistor which may employ the present invention and produce the energy-drop mass relationship of FIG. 7.

Referring to the plan view of a heater resistor in FIG. 8, an essentially square feature 801 is etched into the 6000 Angstrom thick cavitation layer (by a plasma etch process) such that the depth of the feature from the surface of the cavitation layer is 4000 Angstroms. The depth and the thin film structure may be apprehended in FIG. 9, a cross section of the heater resistor taken at section line 9—9. The etching of the cavitation layer means, of course, that the thickness of the cavitation layer at this feature location is approximately 2500 Angstroms. The range of energy values which define the plateau 703 decreases with a reduction of feature 801 depth (a smaller variation in cavitation layer thickness difference). Also, as the location of feature 801 is moved about within the perimeter of the geometric figure which defines the heater resistor, it is found that the range of energies which define the plateau 703 also decreases. Thus, the feature 801, in the preferred embodiment, is centered on the heater resistor. It should be noted, however, that other attributes of the feature (for example, shape, size, depth, number, and location) can be varied in order to obtain a given performance.

Vapor bubble heterogeneous nucleation is energetically favored at the interfaces of feature 801. Moreover, the higher temperature achieved at the thinner protective layer area dictate that the vapor bubble will form within the feature 801 at a heater resistor energy level lower than that of the turn on energy of the heater resistor as a whole. The first plateau 703 of the energy-drop mass relationship is reached at the lower energy range and a smaller drop mass is ejected from the drop generator nozzle. When the higher energy level is applied to the heater resistor, the second plateau 705 of the energy-drop mass relationship is reached. Although the vapor bubble preferentially nucleates at the feature 801, the higher energy available to the heater resistor in total creates a larger vapor bubble and ejects an ink drop with a higher mass of ink.

In the preferred embodiment, the cavitation layer feature 801 is essentially square, having sides of 5 micrometer lengths. Since the most effective location for the feature was experimentally found to be centered over the heater resistor, that is its preferred location, although other design parameters may suggest other locations over the heater resistor. In the preferred embodiment, the heater resistor geometry was that of a square 30 micrometers on a side but other resistor shapes may also be employed. A ratio of areas of the feature to the heater resistor, then, is 25:900 or 1:36. This ratio can vary from a low of 1:4 to a high of 1:57 depending upon the heater resistor size and the feature size used in a selected design.

Figure 9:
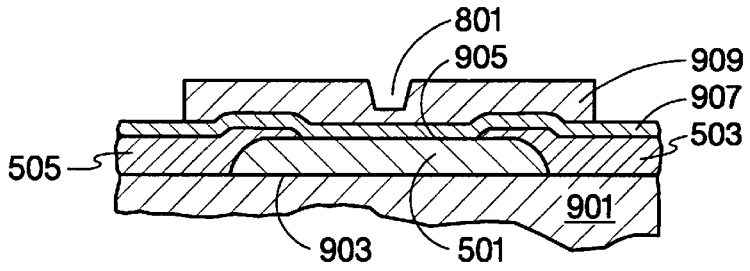
FIG. 9 is a cross section elevation view of the heater resistor of FIG. 7 along section line 9—9.

Considering the cross section 9—9 of FIG. 9, it can be seen that the heater resistor 501 is disposed on the substrate 901 with one of its planar surfaces 903 in contact with a surface of the substrate 901. The other surface of the heater resistor planar surfaces 905 is in contact with the passivation layer 907 and overlain by cavitation layer 909. Electrical contact to the heater resistor 501 is made by conductors 503 and 505, as shown. The substrate 901 is typically a semiconductor such as silicon. The silicon is treated using either thermal oxidation or vapor deposition techniques to form a thin layer of silicon dioxide thereon. Heater resistor 501 is created by depositing a film of resistive material on the silicon dioxide. Preferably, the film is tantalum aluminum, TaAl, which is a well known resistive heater material in the art of thermal inkjet printhead construction. Next, a thin layer of aluminum is deposited to provide conductors 503 and 505.

In the particular materials set described above for a preferred embodiment of the invention, the silicon-silicon dioxide combination is approximately 600 microns in thickness; the tantalum aluminum layer is approximately 1000 angstroms in thickness; and the aluminum layer is approximately 5000 angstroms in thickness. The resistor and conductor materials are conventionally magnetron sputter deposited. A pattern is etched in the aluminum layer to form the opening which defines the lateral extent of the heater resistor element that is current driven by the conductive trace aluminum layer. Then, in the preferred embodiment, a composite layer barrier material is deposited over the upper surface of the structure and includes a first layer of silicon nitride which is covered by a second layer of highly inert silicon carbide. This composite layer passivation material provides both good adherence to the underlying materials and good insulation and protection against cavitation wear and ink corrosion which the underlying layers beneath these materials would otherwise receive during an ink jet printing operation. An area over the heater resistor 501 and its associated electrical connection to conductors 503 and 505 is masked and a cavitation layer 909 of tantalum approximately 6000 Angstroms thick is conventionally sputter deposited.

In an alternative embodiment, the feature 801 is created in the passivation layer of the protective layer by plasma etching. The cavitation layer is then deposited on the contoured passivation layer by conventional sputtering techniques.

Figure 10:
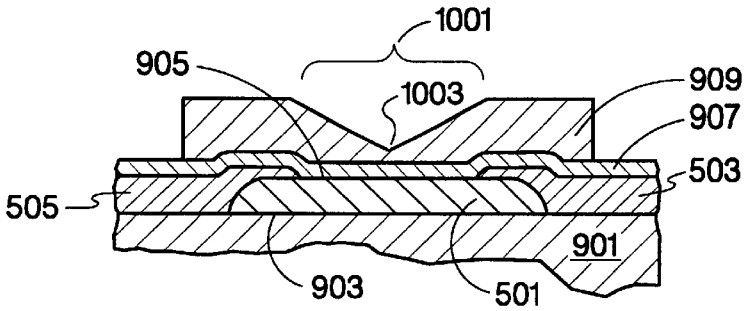
FIG. 10 is an alternative embodiment cross section elevation view of a heater resistor like that of FIG. 7 along section line 9—9.
Figure 11:
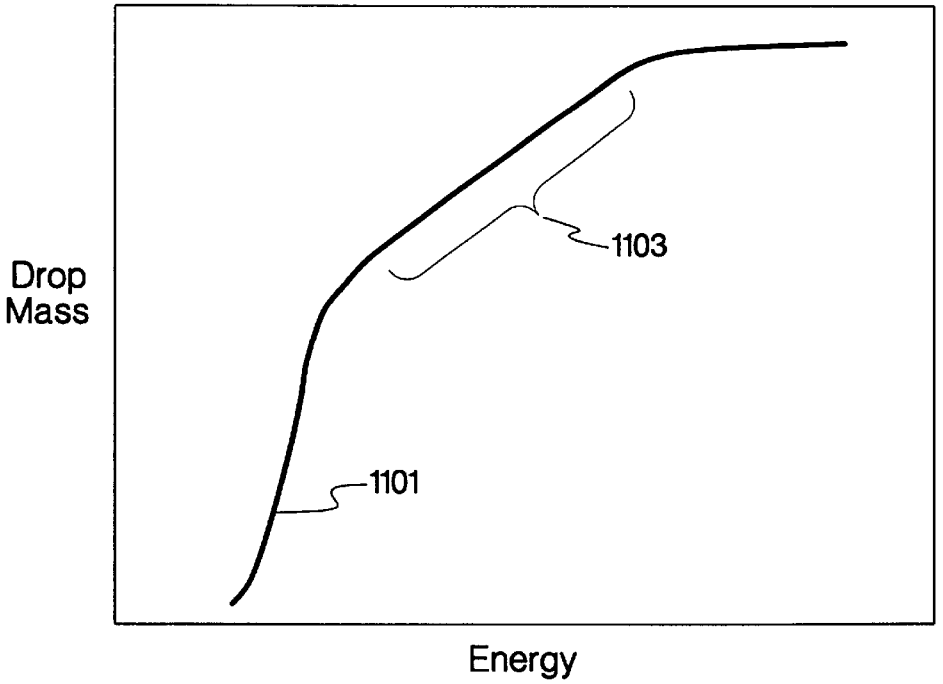
FIG. 11 is an energy-drop weight curve for the alternative embodiment of FIG. 10.

In another embodiment, shown in FIG. 10 (a cross section taken similar to that of FIG. 9), the feature 1001 has its minimum cavitation layer thickness 1003 centered on the heater resistor 501 and slopes to its full thickness at the periphery of the heater resistor. The energy-drop mass curve 1101 for this alternative embodiment is shown in FIG. 11 and has the characteristic of a three slope curve. Of particular interest is the intermediate slope 1103 which offers a nearly linear drop mass response to energy delivered to the resistor without excessive sensitivity to environmental variations.

Figure 12:
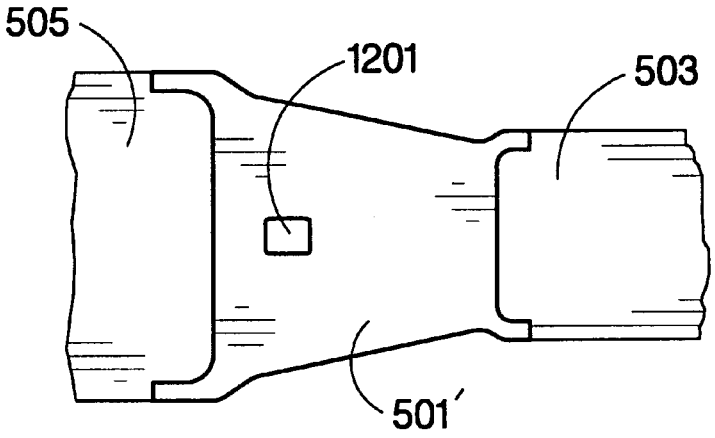
FIG. 12 is an alternative embodiment plan view of a heater resistor geometric shape which may employ the present invention.
Figure 13:
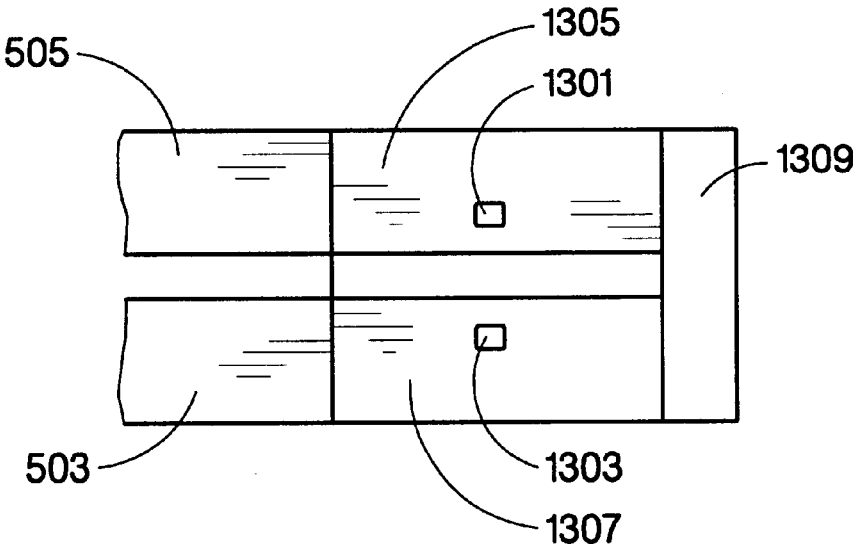
FIG. 13 is an alternative embodiment plan view of a heater resistor arrangement which may employ the present invention.

It has been suggested that a planar heater resistor arranged in a trapezoidal geometric shape would develop isothermal lines related to the input energy and therefore could generate variable sized ink vaporization bubbles dependent upon the energy. Such a configuration is shown in FIG. 12. The trapezoidal planar resistor 501' is electrically connected to conductors 503 and 505. The energy-drop weight curve for such a resistor shape would be similar to that of FIG. 11. The drop weight instability due to environmental variations reduce the value of this resistor configuration without the present invention. The addition of the protective layer thinning feature 1201 disposed over the trapezoidal heater 501' provides a plateau in the energy-drop weight curve and a stability in the drop weight over environmental conditions. In a preferred embodiment, the feature 1201 is placed nearer the wide end of the trapezoid in an aspect of 1:4 and centered between the sides on which no conductor connection is made, although the drop generator designer may adjust the design to fit other design needs.

In another alternative embodiment, the heater resistor 501' is split into two segments 1305 and 1307 and series connected by shorting bar 1309. Electrical power is coupled to the split resistor by conductors 503 and 505. Two features, feature 1301 and feature 1303, are disposed in the protective layer overlaying resistor segments 1305 and 1307, respectively. Ink vapor bubble nucleation commences nearly simultaneously from both features and coalesces into a single bubble to expel ink having a first mass from an associated nozzle when a first energy magnitude is applied to the heater resistor. When a second, larger, energy magnitude is applied to the heater resistor, ink bubble nucleation commences at the two features and grows with heat energy derived from the rest of the surrounding heater resistor protective layer surface. The bubble created with the second energy magnitude is larger and causes an ink drop to be expelled from the associated nozzle with a greater mass than the first mass.

In accordance with the foregoing, an inkjet printing apparatus utilizes a mechanism for dynamically generating ink drops with selectable and stable drop masses so that print quality and color image fidelity can be improved.

We claim:

1. An inkjet printing apparatus for generating a variable mass drop comprising:

a planar heater resistor having a shape of a first geometric figure with a perimeter and disposed on and having a first surface in contact with a substrate;

a first electrical conductor coupled to said planar heater resistor and a second electrical conductor coupled to said planar heater resistor, whereby an electrical voltage applied between said first electrical conductor and said second electrical conductor produces heat energy in and dissipated by said planar heater resistor; and a protection layer disposed at least on a second surface of said planar heater resistor, said protection layer having a first thickness disposed in the shape of a second geometric figure at a predetermined location entirely within a boundary in said protection layer congruent with said perimeter and a second thickness surrounding said first thickness, said second thickness having a greater magnitude than said first thickness to provide said protection layer with a surface that stably nucleates vapor bubbles at least at two energy levels.

2. An inkjet printing apparatus in accordance with claim 1 wherein said predetermined location entirely within said boundary further comprises a location that is centered within said boundary congruent with said perimeter.

3. An inkjet printing apparatus in accordance with claim 1 wherein said second geometric shape is essentially a square.

4. An inkjet printing apparatus in accordance with claim 1 wherein said second thickness of said protection layer surrounding said first thickness further comprises said second thickness being disposed everywhere on said second surface of said planar heater except for said predetermined location of said first thickness.

5. An inkjet printing apparatus in accordance with claim 1 wherein said first thickness is in the range of 0 Angstroms to 4000 Angstroms and wherein said second thickness is in the range of 3000 Angstroms to 6000 Angstroms so long as said first thickness remains less than second thickness.

6. An inkjet printing apparatus in accordance with claim 1 wherein said second geometric figure and said first geometric figure have a ratio of areas ranging from 1:4 to 1:57.

7. An inkjet printing apparatus in accordance with claim 1 wherein said second geometric figure and said first geometric figure have a ratio of areas of essentially 1:36.

8. An inkjet printing apparatus in accordance with claim 1 wherein said protection layer further comprises a passivation layer and a cavitation layer disposed atop said passivation layer.

9. A drop generator to stably eject drops of ink having one of a first mass and a second mass from an inkjet printhead, comprising:

a substrate;

a resistor layer having a predetermined area and disposed on said substrate;

a first heating surface entirely disposed on a portion of, but less than all of, said predetermined area of said resistor layer;

a second heating surface disposed on said predetermined area of said resistor layer except for and entirely surrounding said first heating surface; and a nozzle associated with said first heating surface and said second heating surface;

whereby said first heating surface heats and ejects a drop of ink of the first mass from said nozzle when said resistor layer is supplied a first magnitude of electrical energy and said second heating surface heats and ejects a drop of ink of the second mass from said nozzle when said resistor layer is supplied a second magnitude of electrical energy, the first mass being smaller than the second mass and said first magnitude of electrical energy being smaller than said second magnitude of electrical energy.

10. A drop generator in accordance with claim 9 wherein said first heating surface is centered within said second heating surface.

11. A drop generator in accordance with claim 9 wherein said first heating surface is formed essentially in the shape of a square.

12. A drop generator in accordance with claim 9 wherein said first heating surface and said second heating surface further comprise a protection layer disposed at least on said resistor layer, said first heating surface of protection layer comprising a first thickness of protection layer and said second heating surface of protection layer comprising a second thickness of protection layer, said second thickness having a greater magnitude than said first thickness.

13. A drop generator in accordance with claim 12 wherein said protection layer further comprises a passivation layer and a cavitation layer disposed atop said passivation layer.

14. A drop generator in accordance with claim 9 wherein said first thickness is in the range of 0 Angstroms to 4000 Angstroms and wherein said second thickness is in the range of 3000 Angstroms to 6000 Angstroms so long as said first thickness remains less than said second thickness.

15. A drop generator in accordance with claim 9 wherein said first heating surface and said second heating surface have a ratio of areas ranging from 1:4 to 1:57.

16. A drop generator in accordance with claim 15 wherein said first heating surface and said second heating surface have a ratio of areas of essentially 1:36.

17. A method of stably ejecting drops of ink having one of a first mass and a second mass from a drop generator of an inkjet printhead comprising the steps of:

applying first electrical energy to a planar heater resistor;

heating a first heating surface entirely disposed on a portion of, but less than all of, said planar heater resistor, to nucleate an ink vapor bubble thereon in response to said applying first electrical energy step, and ejecting a drop of ink of the first mass from a nozzle;

applying second electrical energy to said planar heater resistor; and heating said first heating surface and a second heating surface disposed on said resistor layer except for and entirely surrounding said first heating surface, to nucleate an ink vapor bubble thereon in response to said applying second electrical energy step, and ejecting a drop of ink of the second mass from said nozzle the first mass being smaller than the second mass and said first electrical energy being smaller than said second electrical energy.

18. An inkjet printhead comprising a drop generator to stably eject drops of ink having one of a first mass and a second mass, said drop generator further comprising:

a planar heater resistor;

a first heating surface disposed entirely on said planar heater resistor and a second heating surface disposed on said planar heater resistor and entirely surrounding said first heater surface on said planar heater resistor; and an ink ejection nozzle in correspondence with said planar heater resistor, said drop generator vaporizing ink at said first heating surface and ejecting a drop of ink of the first mass from said nozzle when a first range of energies is applied to said planar heater resistor and said drop generator vaporizing ink at said second heating surface and ejecting a drop of ink of the second mass from said nozzle when a second range of energies is applied to said planar heater resistor.

19. An inkjet printhead in accordance with claim 18 wherein said first range of energies is between 3.6 microjoules and 3.8 microjoules and the ink drop first mass is essentially 17 nanograms.

20. An inkjet printhead in accordance with claim 18 wherein said second range of energies exceeds 4.5 microjoules and the ink drop second mass is essentially 23 nanograms.

21. An inkjet printhead in accordance with claim 18 wherein said first heating surface is centered within said second heating surface.

22. An inkjet printhead in accordance with claim 18 wherein said first heating surface and said second heating surface further comprise a protection layer disposed at least on said planar heater resistor, said first heating surface of protection layer comprising a first thickness of protection layer and said second heating surface of protection layer comprising a second thickness of protection layer, said second thickness having a greater magnitude than said first thickness.

23. An inkjet printhead in accordance with claim 18 wherein said protection layer further comprises a passivation layer and a cavitation layer disposed atop said passivation layer.

24. An inkjet printhead in accordance with claim 18 wherein said first thickness is in the range of 0 Angstroms to 4000 Angstroms and wherein said second thickness is in the range of 3000 Angstroms to 6000 Angstroms as long as said first thickness remains less than said second thickness.

25. An inkjet printhead in accordance with claim 18 wherein said first heating surface and said second heating surface have a ratio of areas ranging from 1:4 to 1:57.

26. An inkjet printhead in accordance with claim 18 wherein said first heating surface and said second heating surface have a ratio of areas of essentially 1:36.

27. A method of stably ejecting drops of ink having one of a first mass and a second mass from a drop generator of an inkjet printer apparatus comprising the steps of:

vaporizing ink at a first heating surface entirely disposed on a planar heater resistor;

ejecting a drop of ink of the first mass from a nozzle when a first range of energies is applied to said planar heater resistor;

vaporizing ink at said first heating surface and a second heating surface, said second heating surface disposed on said heater resistor and entirely surrounding said first heater surface on said planar heater resistor; and ejecting a drop of ink of the second mass from said nozzle when a second range of energies is applied to said planar heater resistor.

28. An inkjet printing apparatus stably ejecting drops having one of a first mass and a second mass comprising:

a planar heater resistor having a shape of a first geometric figure with a perimeter and disposed on and having a first surface in contact with a substrate;

a first electrical conductor coupled to said planar heater resistor and a second electrical conductor coupled to said planar heater resistor, whereby an electrical voltage applied between said first electrical conductor and said second electrical conductor produces heat energy dissipated by said planar heater resistor; and a protection layer disposed at least on a second surface of said planar heater resistor, said protection layer having a first thickness disposed in the shape of a second geometric figure at a predetermined location entirely within a boundary in said protection layer congruent with said perimeter and a second thickness surrounding said first thickness, said second thickness having an equal or greater magnitude than said first thickness, said second geometric figure and said first geometric figure have a ratio of areas ranging from 1:4 to 1:57 such that drops of the first mass and drops of the second mass are stably ejected.

29. An inkjet printing apparatus in accordance with claim 28 wherein said predetermined location entirely within said boundary further comprises a location that is centered within said boundary congruent with said perimeter.

30. An inkjet printing apparatus in accordance with claim 28 wherein said second geometric shape is essentially a square.

31. An inkjet printing apparatus in accordance with claim 20 wherein said second thickness of said protection layer surrounding said first thickness further comprises said second thickness being disposed everywhere on said second surface of said planar heater except for said predetermined location of said first thickness.

32. An inkjet printing apparatus in accordance with claim 28 wherein said first thickness is in the range of 0 Angstroms to 4000 Angstroms and wherein said second thickness is in the range of 3000 Angstroms to 6000 Angstroms so long as said first thickness remains less than said second thickness.

33. An inkjet printing apparatus in accordance with claim 28 wherein said second geometric figure and said first geometric figure have a ratio of areas of essentially 1:36.

34. An inkjet printing apparatus in accordance with claim 28 wherein said protection layer further comprises a passivation layer and a cavitation layer disposed atop said passivation layer.

* * * * *

UNITED STATES PATENT AND TRADEMARK OFFICE

CERTIFICATE OF CORRECTION

PATENT NO. : 6,227,640 B1
DATED : May 8, 2001
INVENTOR(S) : Maze et al.

It is certified that error appears in the above-identified patent and that said Letters Patent is hereby corrected as shown below:

Column 14,
Line 5, delete "20" and insert therefor -- 28 --.

Signed and Sealed this

Seventeenth Day of February, 2004

JON W. DUDAS
*Acting Director of the United States Patent and Trademark Office*